United States Patent [19]

Spencer

[11] Patent Number: 4,747,892

[45] Date of Patent: May 31, 1988

[54] MELT-CASTABLE EXPLOSIVE COMPOSITION

[75] Inventor: Arthur F. Spencer, Niceville, Fla.

[73] Assignee: The United States of America as represented by the Secretary of the Air Force, Washington, D.C.

[21] Appl. No.: 56,864

[22] Filed: May 22, 1987

[51] Int. Cl.[4] ..... C06B 45/08

[52] U.S. Cl. ..... 149/20; 149/38; 149/43; 149/44; 149/88; 149/92; 149/18

[58] Field of Search ..... 149/20, 18, 92, 38, 149/43, 44, 88

[56] References Cited

U.S. PATENT DOCUMENTS

| | | | |
|---|---|---|---|
| 829,362 | 8/1906 | Barthelemy | 149/20 |
| 3,388,554 | 6/1968 | Hodgson I | 149/18 |
| 3,414,443 | 12/1968 | Pheasant et al. | 149/18 |
| 3,466,205 | 9/1969 | Boileau et al. | 149/18 |
| 3,472,713 | 10/1969 | Berthmann et al. | 149/92 |
| 3,507,719 | 4/1970 | Hodgson II | 149/18 |
| 3,706,609 | 12/1972 | Voigt, Jr. et al. | 149/18 |
| 3,994,756 | 11/1976 | Hendrickson, Sr. et al. | 149/18 |
| 4,000,021 | 12/1976 | Voigt, Jr. | 149/17 |
| 4,098,625 | 7/1978 | French et al. | 149/19.3 |
| 4,232,606 | 11/1980 | Yunan | 102/27 R |
| 4,251,301 | 2/1981 | Voigt, Jr. | 149/12 |
| 4,284,442 | 8/1981 | Voigt, Jr. | 149/19.4 |
| 4,369,688 | 1/1983 | Yunan | 86/1 R |
| 4,376,083 | 3/1983 | Ulsteen | 264/3 |
| 4,417,900 | 11/1983 | Barthel | 149/18 |
| 4,445,948 | 5/1984 | Stanton et al. | 149/19.91 |
| 4,608,210 | 8/1986 | Müller et al. | 264/3.2 |

*Primary Examiner*—Stephen J. Lechert, Jr.

*Attorney, Agent, or Firm*—Charles E. Bricker; Donald J. Singer

[57] ABSTRACT

A melt castable explosive composition not based on TNT is disclosed which consists essentially of about 10 to 20 weight percent of a matrix material having a melting temperature of about 60° to 100° C., up to about 0.5 weight percent of an emulsifying agent and up to about 20 weight percent aluminum powder, balance high explosive. The matrix material is ozokerite wax, ozokerite modified with carnauba wax, or a waxy polyethylene.

6 Claims, No Drawings

MELT-CASTABLE EXPLOSIVE COMPOSITION

RIGHTS OF THE GOVERNMENT

The invention described herein may be manufactured and used by or for the Government of the United States for all governmental purposes without the payment of any royalty.

BACKGROUND OF THE INVENTION

This invention relates to an improved castable high explosive, particularly to a castable explosive composition containing explosives which melt and/or decompose at temperatures higher than about 90° C.

Castable explosives are classified either as melt/cast or as plastic bonded. Melt/cast systems require the melting of the explosive, such as TNT (mp 81° C.), and casting into a munition. Plastic bonded systems involve a mixture of one or more explosives with a polymeric binder, casting into a munition, and curing of the binder.

Explosive compositions based on TNT constitute an important class of military explosives. Examples of such explosive compositions include Composition B (RDX-cyclotrimethylenetrinitramine and TNT-2,4,6-trinitrotoluene), Tritonal (TNT and aluminum powder), cyclotols (RDX and TNT in ratios of 75:25 to 60:40), Amatol (ammonium nitrate and TNT), Kalatol (potassium nitrate and TNT), Baratol (barium nitrate and TNT, Pentolite (PETN-pentaerythritol tetranitrate and TNT) and Baronal (barium nitrate, aluminum and TNT). Such compositions are generally prepared by stirring the solid powdered components, which include such materials as RDX, HMX (cyclotetramethylenetetranitramine), PETN, NQ (nitroguanidine), ammonium nitrate, potassium nitrate, barium nitrate, lead nitrate, potassium perchlorate, ammonium perchlorate, aluminum powder, and the like, as well as mixtures thereof, which are essentially insoluble in TNT, with molten TNT until a homogeneous dispersion or slurry is obtained. The molten slurry is loaded into shells or other ordnance items by pouring into the cavity and allowing the melt to cool and solidify. Such slurries, which in concentrated cases are very viscous and difficult to pour, exhibit undesirable segregation and settling of the solids during the period required for cooling and solidification, thereby producing casts of non-uniform composition, which adversely affects the explosive and ballistic characteristics of the item. In the past, small amounts of additives, such as finely divided silica, silicone resins, nitrocellulose and other cellulosic resins, have been added to improve the suspension of the solid components in the TNT slurry.

TNT-based explosive compositions have a tendency to exude low melting impurities such as dinitrotoluene and mononitrotoluene, as well as unsymmetrical isomers of trinitrotoluene. It is known that high molecular weight nitrocellulose has the propensity to accept these low melting impurities of the composition. As a result of substantially high uptake in this regard, relatively small amounts of the nitrocellulose are necessary to prevent exudation of the cast. Thus, the viscosity of the melt is not appreciably altered by the addition of such cellulosic additive and the pourability of the composition is maintained. It has also been found that by such addition of cellulosic material, an explosive cast is obtained having greater mechanical strength and enhanced heat resistance.

In addition to exudation, TNT-based explosive compositions tend to crack upon temperature cycling, decompose autocatalytically upon exposure to fire and explode or detonate when in a bomb or warhead configuration, and further tend to detonate on sudden impact. These drawbacks have been partially corrected in the past by using wax type coatings as desensitizers and process aids. Beeswax was used initially at a level of about 1 wt. percent to desensitize Composition B. Shortages of beeswax led to a search for substitutes which concentrated on paraffin wax, microcrystalline waxes and synthetic waxes. Such wax coatings are deposited irregularly as agglomerates onto the explosive composition. As such, wax coatings tend to separate from the explosive composition surface upon exposure to heat and create potential cook-off conditions.

The waxes employed heretofore are generally not soluble in TNT. In order to form an emulsion of the explosive and wax, emulsifying aids are often added, as for example, lecithin as an emulsifier. Dispersions of 5% or greater of paraffin wax in TNT-based explosives are not truly stable emulsions.

As noted previously, plastic bonded systems involve a mixture of one or more explosives with a polymeric binder. Binders used heretofore include polyester, polyurethane, polystyrene, fluorinated polymers and various synthetic rubbers. Plastic bonded systems require thorough mixing of the ingredients with special emphasis on the quantity and mixing of the curing agent or catalyst. Once cast into a munition, a cure time of several days, at an elevated temperature, is required to ensure complete cure of the binder.

Plastic bonded systems have an advantage over conventional melt/cast systems in that virtually any explosive can be cast into a munition. In particular, explosives can be cast into munitions independent of the melt temperature of the explosive(s), while conventional melt/cast systems depend on at least one explosive ingredient being meltable at a safe processing temperature. The phrase "safe processing temperature" generally means about 121° C. or lower which corresponds to the temperature of steam at 15 psig.

Melt/cast systems have an advantage over plastic bonded systems of higher processing and loading capacity. The melt/mix time is relatively much shorter, process control is not as critical, and no curing time is required. Melt/cast systems have a further advantage if unloading of the munition is ever required in that the cast explosive can be melted using a low pressure steam.

What is desired is an explosive composition which has the advantages of both the melt/cast and plastic bonded systems. The desired composition alloys melt/cast processing without dependence on the melt temperature of the explosive ingredients.

It is an object of the present invention to provide a novel explosive composition.

It is another object of the present invention to provide an improved method for melt/cast loading of munitions.

Other objects, aspects and advantages of the present invention will be apparent to those skilled in the art.

SUMMARY OF THE INVENTION

In accordance with the present invention there is provided a novel explosive composition consisting essentially of at least one high explosive having a melting temperature greater than about 90° C., and a non-explosive matrix material or binder having a melting temperature of about 60°-100° C. and, optionally, aluminum powder and/or an emulsifying or wetting agent.

The matrix material, or binder, is a natural or synthetic wax, including mixtures thereof, having a melting temperature of about 60°-100° C. Suitable matrix materials include ozokerite waxes, mixtures of ozokerite and carnauba waxes containing about 5 to 25 wt. percent carnauba, and waxy polyolefins. A particularly suitable matrix material is identified as Polywax, available commercially from Petrolite Corp., Bareco Division, Tulsa OK, and available in a variety of molecular weights.

The use of up to about 0.5 wt. percent of an emulsifying agent, such as lecithin, together with the matrix material, is preferred in order to reduce the viscosity of the mix.

The explosive material can be any high explosive. High explosives are generally characterized by being solid at room temperature but also up to at least 100° C., and by having a high brisance which supposes a high density and a high detonation rate. Suitable high explosives include PETN, RDX, HMX, NQ, and the like, as well as mixtures thereof. It is also within the scope of this invention to substitute an oxidizing agent, such as potassium nitrate, for up to about 60 weight percent of the high explosive.

The explosive composition of this invention consists essentially of about 10 to 20 weight percent binder, 0 to 20 weight percent aluminum powder and about 60 to 90 weight percent explosive material.

The following example illustrates the invention:

EXAMPLE

The following compositions were prepared:

TABLE I

| | | Explosive Compositions (parts by weight) | | |
|---|---|---|---|---|
| Group | Component | I | II | III |
| A | Binder (60 w % Ozokerite, 40 w % carnauba) | 15.0 | — | — |
| | Binder (Polywax 500) | — | 17.0 | 12.0 |
| | Lecithin | 0.2 | 0.2 | 0.2 |
| B | Aluminum Powder | 7.8 | 16.0 | 16.0 |
| | High Bulk Density Nitroguanidine | 50.0 | 45.0 | — |
| | Potassium Nitrate | — | — | 41.0 |
| C | RDX - Class A | 27.0 | 22.0 | — |
| | RDX - Class C | — | — | 31.0 |

The above compositions were prepared as follows:

1. The binder component was melted, then the lecithin was added, with mixing until completely dissolved.

2. The components of Group B were added, with mixing, to the melted binder.

3. The RDX was added, with mixing, to the composition.

4. The composition was placed under vacuum at about 90°-95° C. for about 10 minutes.

5. The compositions were cast into suitable containers and allowed to cool to room temperature.

The explosive properties of compositions II and III are compared with Tritonal in Table II, below:

TABLE II

| | Explosive Properties | | |
|---|---|---|---|
| | II | III | Tritonal |
| Shock Sensitivity (K bar) | 45.0 | — | 14.0 |
| Detonation Velocity (km/sec) | 6.9 | 6.5 | 6.5 |
| Critical Diameter (inch) | 1.5 | — | 1.0 |
| Plate dent (mm) (2" dia × 6" confined, 1" armor plate) | 15.0 | — | 18.0 |

Composition II was loaded into MK 82 bombs, which were then tested for sympathetic detonation and slow cookoff.

In a first sympathetic detonation test, the test bomb was placed side-by-side with a Tritonal-loaded MK 82 bomb, with ¾-inch air spacing at the closest point. The Tritonal-loaded bomb was remotely detonated. There was no propagation to the test bomb.

In a second sympathetic detonation test, a Tritonal-loaded MK 82 bomb was placed in the bottom-center location of a 6-bomb pallet having ¾-inch plywood spacers. Test bombs were placed in the remaining locations. The Tritonal-loaded bomb was remotely detonated. There was no propagation to the test bombs.

In the slow cookoff test, a test bomb was heated in an oven at the rate of 3.3° C. per hour, until reaction occurred, at which time the nose fuzewell ruptured and the explosive burned. No fragments were thrown and the bomb case was later recovered intact.

Various modifications may be made without departing from the spirit of the invention or the scope of the appended claims.

I claim:

1. A melt castable explosive composition consisting essentially of about 10 to 20 weight percent of a matrix material having a melting temperature of about 60° to 100° C., up to about 0.5 weight percent of an emulsifying agent, up to about 20 weight percent aluminum powder, balance high explosive.

2. The composition of claim 1 wherein said high explosive has a melting temperature greater than about 90° C.

3. The composition of claim 1 containing 15 parts by weight of a matrix consisting of a 3:2 mixture of ozokerite and carnauba waxes, 0.2 parts lecithin, 7.8 parts aluminum powder, 50 parts nitroguanidine and 27 parts cyclotrimethylenetrinitramine.

4. The composition of claim 1 containing 17 parts waxy polyethylene matrix, 0.2 parts lecithin, 16 parts aluminum powder, 45 parts nitroguanidine and 22 parts cyclotrimethylenetrinitramine.

5. The composition of claim 1 containing 12 parts waxy polyethylene matrix, 0.2 parts lecithin, 16 parts aluminum powder, 41 parts potassium nitrate and 31 parts cyclotrimethylenetrinitramine.

6. The composition of claim 1 wherein said matrix material is selected from the group consisting of ozokerite wax, a mixture of ozokerite and carnauba waxes containing a major portion of ozokerite wax, and waxy polyethylene.

* * * * *